US010249420B2

(12) United States Patent
Kesgin et al.

(10) Patent No.: US 10,249,420 B2
(45) Date of Patent: Apr. 2, 2019

(54) CONTINUOUS WINDING MAGNETS USING THIN FILM CONDUCTORS WITHOUT RESISTIVE JOINTS

(71) Applicant: UCHICAGO ARGONNE, LLC, Chicago, IL (US)

(72) Inventors: Ibrahim Kesgin, Willowbrook, IL (US); Ulrich Welp, Lisle, IL (US); Charles L. Doose, Clarendon Hills, IL (US); Matthew Kasa, New Lenox, IL (US); Yury Ivanyushenkov, Darien, IL (US)

(73) Assignee: UChicago Argonne, LLC, Chicago, IL (US)

( * ) Notice: Subject to any disclaimer, the term of this patent is extended or adjusted under 35 U.S.C. 154(b) by 452 days.

(21) Appl. No.: 14/962,521

(22) Filed: Dec. 8, 2015

(65) Prior Publication Data

US 2017/0162309 A1 Jun. 8, 2017

(51) Int. Cl.

| | |
|---|---|
| ***H01F 6/06*** | (2006.01) |
| ***B65H 18/10*** | (2006.01) |
| ***B65H 18/28*** | (2006.01) |
| ***H01F 41/04*** | (2006.01) |
| ***H05H 7/04*** | (2006.01) |

(52) U.S. Cl.

CPC ..... *H01F 6/06* (2013.01); *B65H 18/106* (2013.01); *B65H 18/28* (2013.01); *H01F 41/048* (2013.01); *H05H 7/04* (2013.01); *B65H 2301/41398* (2013.01); *B65H 2301/41461* (2013.01); *B65H 2301/412845* (2013.01); *B65H 2301/414321* (2013.01); *B65H 2401/211* (2013.01); *B65H 2403/942* (2013.01); *H05H 2007/041* (2013.01)

(58) Field of Classification Search

CPC ..... H05H 2007/41; H05H 7/04

See application file for complete search history.

(56) References Cited

U.S. PATENT DOCUMENTS

| | | | | |
|---|---|---|---|---|
| 4,523,168 | A * | 6/1985 | Emanuelson | H01S 3/0903 335/296 |
| 5,263,035 | A * | 11/1993 | Leboutet | H01S 3/0903 372/2 |
| 5,351,248 | A * | 9/1994 | Iracane | H01S 3/0903 315/5 |
| 8,712,489 | B2 * | 4/2014 | Schauwecker | H01F 6/06 505/211 |
| 8,849,364 | B2 | 9/2014 | Boffo et al. | |
| 2010/0045410 | A1 * | 2/2010 | Beckenbach | H05G 2/00 335/299 |
| 2011/0172104 | A1 * | 7/2011 | Moser | H05H 7/04 505/150 |
| 2011/0290379 | A1 * | 12/2011 | Murokh | B32B 15/01 148/527 |

(Continued)

*Primary Examiner* — Kevin M Bernatz

(74) *Attorney, Agent, or Firm* — Foley & Lardner LLP

(57) ABSTRACT

A continuous winding method produces a continuously wound electrical device, such an undulator. A continuous tape is wound about a series of turn around pins and in grooves in a magnetic core. A plurality of winding stacks are created, each transitioning to the next sequential stack by a transition tape portion extending from one turn around pin to the next turn around pin, which is position opposite with regard to the location of the pin on the magnetic core.

15 Claims, 4 Drawing Sheets

(56) References Cited

U.S. PATENT DOCUMENTS

2012/0286084 A1* 11/2012 Ko ..... B65H 75/14
242/430
2013/0099881 A1* 4/2013 Deyhim ..... H01F 41/048
335/216
2013/0130914 A1* 5/2013 Boffo ..... G21K 1/093
505/211
2014/0243207 A1* 8/2014 Takayasu ..... H01F 41/0629
505/211
2014/0301415 A1* 10/2014 Harrison ..... H01S 1/005
372/2
2015/0129772 A1* 5/2015 Candler ..... H05H 7/04
250/396 ML
2017/0184975 A1* 6/2017 Nikipelov ..... G03F 7/70025

* cited by examiner

CONTINUOUS WINDING MAGNETS USING THIN FILM CONDUCTORS WITHOUT RESISTIVE JOINTS

STATEMENT OF GOVERNMENT INTEREST

The United States Government has rights in the invention described herein pursuant to Contract No. DE-AC02-06CH11357 between the United States Department of Energy and UChicago Argonne, LLC, as operator of Argonne National Laboratory.

FIELD OF THE INVENTION

The present invention generally relates to magnet windings, specifically to those made from high-temperature superconducting (HTS) coated conductors.

BACKGROUND OF THE INVENTION

This invention, in general, pertains to the fabrication of superconducting magnets utilizing thin film conductors. In particular, we describe and demonstrate a technique that allows for the continuous winding of undulator magnets using HTS Rare-Earth (RE) Barium Copper Oxide (REBCO) coated conductor tapes.

The availability of powerful, partly coherent x-ray and deep UV beams has enabled tremendous advances in science and technology across a broad range of disciplines, including materials science, biology, pharmacology and nanoscience. The central components in storage rings and/or free electron laser based light sources that actually generate high-brilliance x-ray radiation are the undulators. Undulators establish a spatially periodic pattern of magnetic fields along the trajectory of relativistic electrons, which induces a periodic component in the electron motion that in turn results in the emission of electromagnetic radiation. An important figure of merit describing an undulator is the deflection parameter K given as $K=0.934\lambda_u$ [cm] $B_0$ [T], where $\lambda_u$ is the period of the magnetic pattern and $B_0$ is the peak on-axis magnetic field. The wavelength range over which the emitted radiation is tunable and the brightness of the emitted beam depend on K; therefore, the on-axis field of the undulator. Therefore, the design and fabrication of undulators delivering high on-axis magnetic fields is a central task in the planning of next-generation light sources. Undulators comprised of superconducting solenoids that are wound onto ferromagnetic cores (for short superconducting undulator, SCU) have emerged as the most promising approach for reaching high $B_0$, and, at the same time, high uniformity (low phase errors) of the device. Currently, a large majority of the developmental work on SCUs utilizes NbTi superconducting wires. The wire technology of NbTi is highly developed; however, this material, which has comparatively low superconducting transition temperature of $T_c$~10 K and upper critical field of 14 T, reaches its material limitations particularly in regards to the high-field critical current density at an operating temperature of 4.2 K, and further performance enhancements of SCU will require the use of different superconducting materials. $Nb_3Sn$ with a $T_c$ of 18 K and an upper critical field in excess of 25 T is being employed for high-field magnets and for large-scale magnets in high-energy physics experiments and fusion reactor technology. Efforts at LBNL and at Ohio State University pursue $Nb_3Sn$ for SCUs. Even though $Nb_3Sn$ is a well-established material allowing for significantly enhanced performance as compared to NbTi, its metallurgy is complicated. For instance, magnets have to be fabricated in the wind-and-react approach in which a precursor wire is wound into the final shape that is subsequently reacted into the $Nb_3Sn$ phase in a high-temperature (650-700° C.) annealing step. Dimensional deformations of the undulator core that can occur during this annealing step interfere with the need for very tight mechanical tolerances of the undulator, an issue that has not been resolved yet and also after high-temperature annealing step, wire becomes brittle which results in performance degradation.

So-called high-temperature superconducting materials offer an alternative to the traditional Nb-based superconductors. In regards to wire development, the most promising candidates are $MgB_2$ ($T_c$~35-39 K), either round wire or tape, Bi-2212 round wire ($T_c$~80-90 K) or REBCO coated conductor tapes ($T_c$~90 K). In addition to improved undulator performance in terms of high-field critical current density, that is, achievable on-axis field, an important benefit arises from the high-transition temperature, which enables operation at a temperature higher than 4.2 K, thereby making possible the use of cryogen-free cryocoolers, and enabling the use of a less complex and cheaper cooling system than is currently required for NbTi-magnets. Furthermore, operation at a temperature higher than 4.2 K eliminates cooling problems related to the heat load generated by the electron beam, which could reach as high as 45 W in the case of a beam injection accident. Managing this head-load requires expensive cryogenic equipment for operating NbTi-undulators. The higher stability margin of HTS will make future HTS-undulators less sensitive to electron-beam-induced heat loads. For example, at an operation temperature of 10 K, the undulator could be in direct contact with the electron-beam pipe, without the need of intervening vacuum spaces.

The current performance of $MgB_2$ wires does not surpass that of NbTi yet. Bi-2212 round wires require a wind-and-react process in which the superconducting material is formed in a high-temperature annealing step (~900° C.,). Thus, this wire incurs the same challenges as $Nb_3Sn$ (see above). REBCO coated conductors offer an attractive opportunity to realize next generation SCUs. This conductor does not require an annealing process and it is ready to wind as received. Coated conductors are composed of a highly engineered layered structure aimed at achieving as perfect as possible a textured structure of the REBCO layer. A possible drawback is that in the final conductor only roughly 1% of the cross-section is superconducting. Nevertheless, tremendous improvements have been made in the current-carrying capability of REBCO conductors by modifying their microstructure such that the engineering critical current density, $J_e$, that is, the critical current density per wire, exceeds that of NbTi under the anticipated operating conditions.

Thus, REBCO coated conductors can enable the next phase in undulator technology. A major hurdle in realizing this potential arises from the difficulties in transferring well-established magnet technologies developed for Nb-based wires to the tape-shaped REBCO-conductors. In particular, due to their large aspect ratio (width versus thickness) the tapes tolerate only small side-bending (bending within the plane of the tape); furthermore, normal bending is typically limited to bend diameters larger than 0.5" in order to avoid irreversible degradation of the critical current. Therefore, the traditional layer-by-layer winding approach is, in most cases, not feasible with coated conductors, and HTS magnets are typically wound as a stack of so-called pancake coils. In each pancake coil the tape is wound on itself from the inside out to the desired outer diameter of the magnet. Connecting the pancake coils to each other and to the current leads is challenging, and various schemes have been proposed. If all the winding stacks have the same polarity, one can—at the expense of some side-bending—wind two winding stacks that are connected on the inner most winding layer through an inclined section of conductor by using two feed bobbins resulting in a double winding stack coil. In one design, successive double winding stacks are connected through a soldered bridge joint on the outer surface of the magnet. In a planar undulator successive pancake coils have opposite polarity (winding direction) in order to generate the periodic magnetic pattern, and winding stacks need to be connected through soldered bridge joints on the inner winding layer and on the outside. Such a scheme has recently been realized in a collaboration between the ANKA synchrotron in Karlsruhe, Germany, and Babcock Noell GmbH, Wurzburg, Germany. However, this design did not perform well as compared to NbTi-based undulators since the achieved $J_e$ was only about 700 A/mm$^2$.

A major drawback that is likely to prevent the scalability of this design to a full-scale undulator is the large number of soldered bridge joints, two per pancake coil. In contrast to Nb-based superconductors, it is currently not possible to make truly superconducting joints between sections of coated conductors in the environments typical for coil winding; the soldered bridge joints are resistive. A recently reported procedure for making superconducting joints requires delicate post-processing involving high-temperature post-annealing in oxygen and under pressure. Detailed procedures for splicing coated conductors have been established and contact resistivities as low as 40-50 nΩcm$^2$ can be achieved. For a 4-mm wide conductor and 5 cm splice length this would imply a resistance of 50 nΩ per bridge joint, or a power dissipation of 0.1 W per pancake coil at an operating current of 1000 A. This level of dissipation exceeds the cooling capacity of the cryocoolers currently used for NbTi-undulators, and in fact, maybe off-set the anticipated higher temperature margins of HTS undulators. On general grounds, the resistive joints may be regarded as weak spots in the undulator. The localized heat generation may cause quenches of the superconductor nearby. Furthermore, the mechanical stiffness of the joint is very different than that of the isolated coated conductor, which could cause damage due to differential thermal contraction on cool-down.

Here, we disclose and demonstrate a new technology for continuous coil winding of REBCO coated conductor tapes for the fabrication of SCUs. This technology overcomes the problems related to winding of these tape-shaped superconductors and that have prevented to fully-utilize the superior materials properties of REBCO for the next generation of SCUs.

SUMMARY OF THE INVENTION

One embodiment of the invention relates to an undulator. The undulator includes a ferromagnetic core having a plurality of parallel groves at least partially circumferentially about the core. A plurality of turnaround pins are affixed to the core, with a first group positioned along one side of the core and a second group positioned along the other side of the core. Each of the plurality of pins associated with one of the plurality of parallel grooves. A continuously wound tape is wound about each of the plurality of pins and the associated one of the plurality of parallel grooves, forming a winding stack. The continuously wound tape further having a plurality of transition tape portions, each of the plurality of transition tape portions extending from one of the turnaround pins to a succeeding pin and wrapping helically in the reverse direction under the next succeeding pin.

In another embodiment, the invention relates to an undulator. The undulator includes a ferromagnetic core having a plurality of parallel groves at least partially circumferentially about the core. A first turnaround pin is affixed to the core at adjacent a first side of the core and associated with a first winding path of the core. A second turnaround pin is affixed to the core at adjacent a second side of the core and associated with a second winding path of the core A continuously wound tape is wound about each of the first turnaround pin and the first winding path of the core to form a first pancake coil. A transition portion of the continuously wound tape extends from the first turnaround pin to the second turn around pin. The continuously wound tape is wound about each of the second turnaround pin and the second winding path of the core to form a second pancake coil.

In another embodiment, the invention relates to a method of winding a continuous high temperature superconductor (HTS) tape in an undulator. The method includes inserting the continuous HTS tape into the undulator. The method further comprising creating a first pancake coil consisting of a first plurality of winding loops by: wrapping about a portion of a first turnaround pin and about a first groove in a magnetic core of the undulator wrapping back around the first turnaround pin to form a first winding stack winding loop; continuing wrapping of the tape about the first turnaround pin and first groove; positioning a second turnaround pin opposite the first turn around pin on the core and extending over a portion of the first groove and a portion of a second groove parallel with the first groove; creating a first transition tape portion extending from the first turnaround pin to the second groove. The method further comprising creating a second winding stack consisting of a second plurality of winding loops by: wrapping about a portion of a second turnaround pin and about a second groove in a magnetic core of the undulator wrapping back around the second turnaround pin to form a second winding stack winding loop; continuing wrapping of the tape about the second turnaround pin and second groove; positioning a third turnaround pin opposite the second turnaround pin and threaded into the first turnaround pin on the core and extending over an opposite second groove portion; and creating a second transition tape portion extending from the second turnaround pin to the third groove.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The foregoing and other objects, aspects, features, and advantages of the disclosure will become more apparent and better understood by referring to the following description taken in conjunction with the accompanying drawings, in which:

FIG. 3A shows a top-view of the winding; FIG. 3B shows a side view of the undulator magnet showing the current directions; FIG. 3C is a perspective view of the overall winding of undulator pack showing the turnarounds and current directions at the top of the undulator coil packs.

DETAILED DESCRIPTION OF THE PREFERRED EMBODIMENTS

Figure 1:
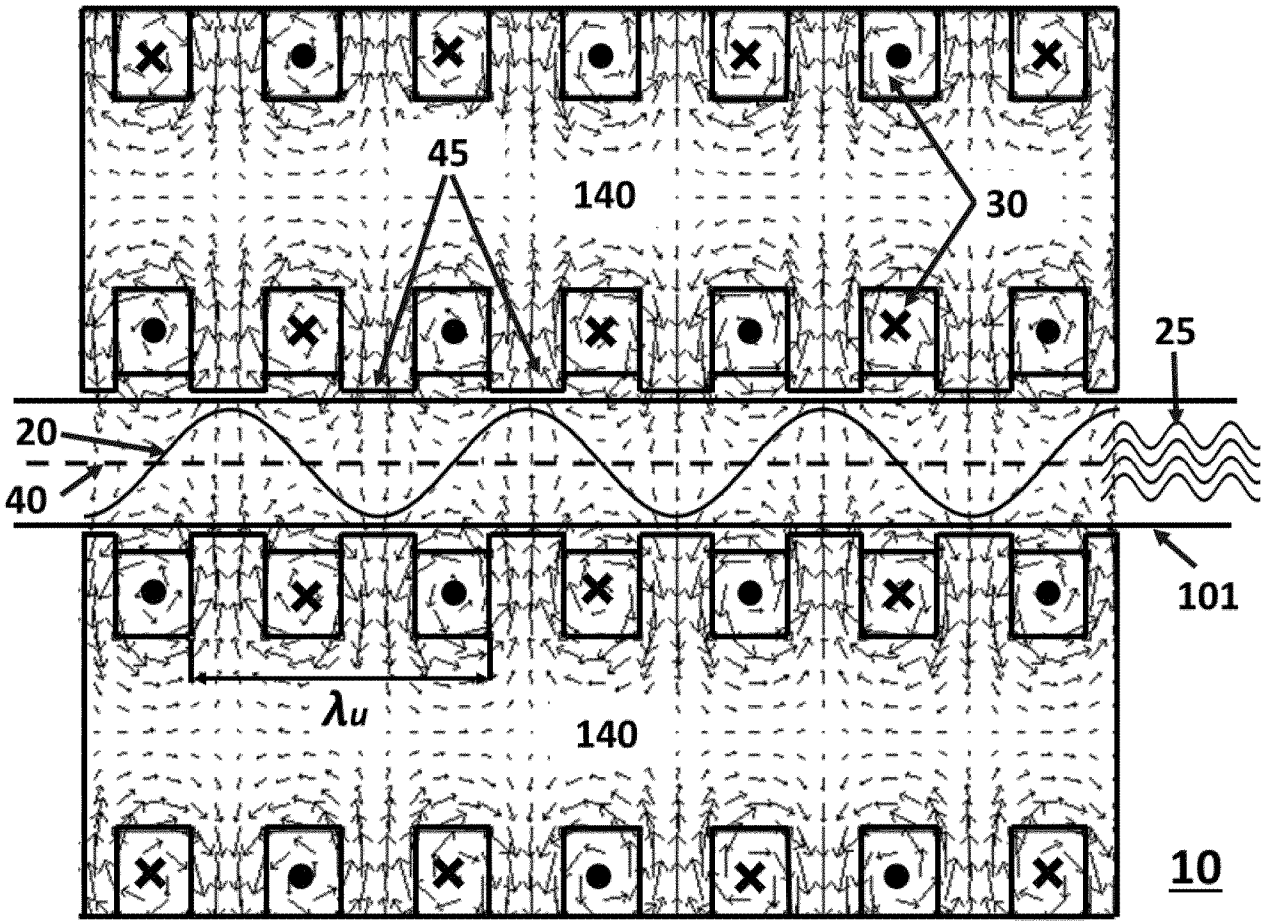
FIG. 1 displays a cross-section of a planar undulator showing the superconducting coils, emitted photons, electrical current directions and the magnetic field distribution along the axis of the magnetic structure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

FIG. 1 shows the fundamental principle of an undulator 10 with its components. Only the parts that are closest to the electron beam 40 (dashed horizontal line) are shown for clarity. The magnet windings 30 are wound into the grooves of a ferromagnetic core 140. Dots and crosses indicated a current flow direction into the page and out of the page, respectively. The magnetic field generated by the currents is concentrated by the magnetic poles 45. Successive magnet windings 30 have opposite polarity resulting in the periodic on-axis magnetic field 20 with an amplitude of $B_0$. The magnetic field arrows are also shown. One magnetic undulator period, $\lambda_u$, encompasses two magnetic poles and two coil sets with opposing polarity. The generated photons, shown as small waves 25 in the figure, propagate essentially along the electron beam 40. Due to relativistic effects, their wavelength is much shorter than $\lambda_u$. Sufficiently long undulators will generate coherent x-ray radiation when the magnetic pattern is the same from period to period, that is, phase errors are negligible.

Figure 2:
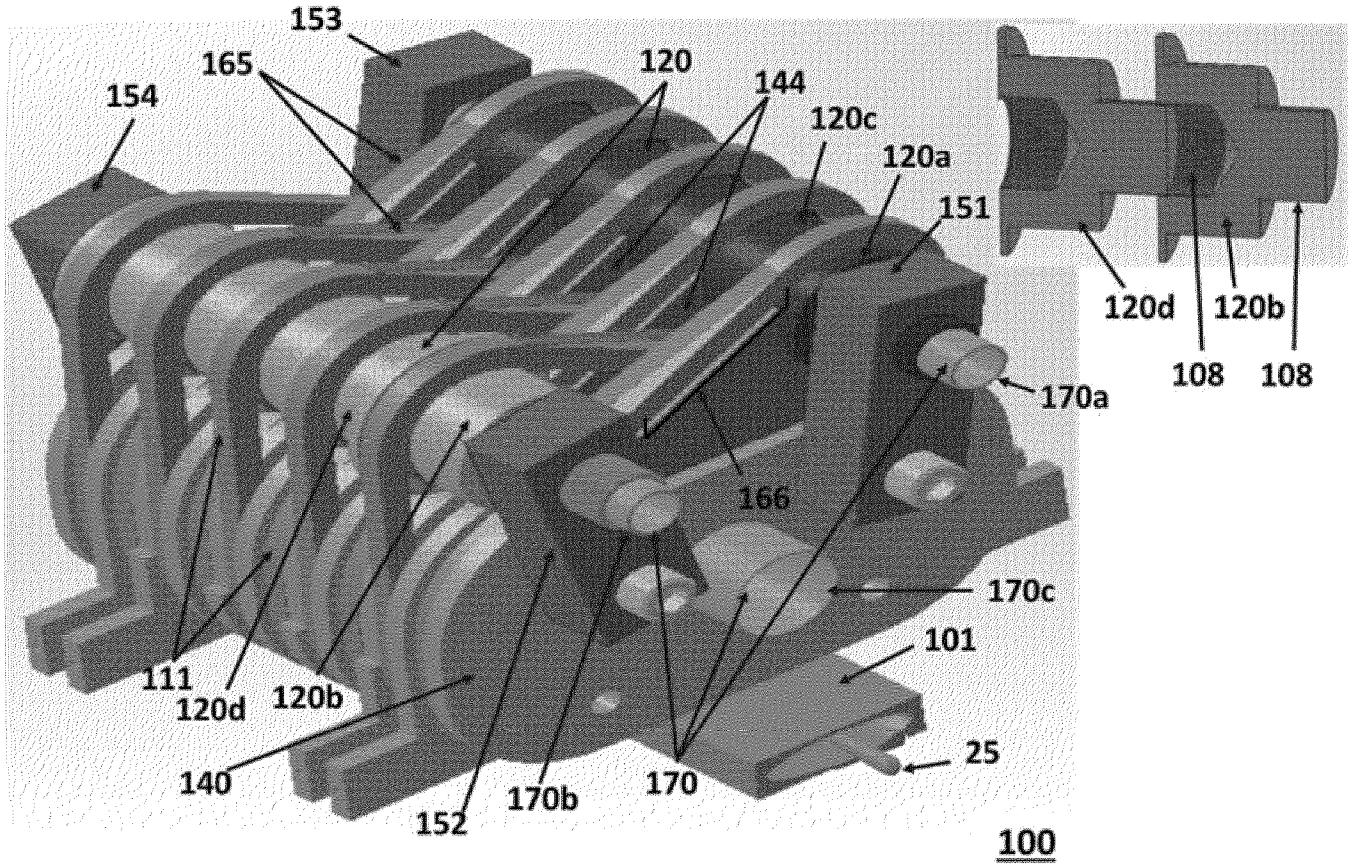
FIG. 2 is an overview of the winding scheme showing all major components of the prototype undulator magnet. The inset shows the details on two turnaround pins.

FIG. 2 describes the procedure for fabricating a planar superconducting undulator 100 using ribbon or thin, high aspect ratio conductors, for example REBCO coated conductors and wound in a continuous fashion such that there is no need for resistive splices to form superconducting windings 111. In various embodiments, the methods described herein can be used with tape-shaped conductors, such as REBCO coated conductors described herein. In a preferred embodiment, the aspect ratio is about 40 but may be greater than 40 or less than 40 in other embodiments. As described below, the winding procedure utilizes auxiliary turnaround pins 120 that enable to reverse the polarity of successive coils. These pins 120 become an integral part of the final magnet structure; in fact, they also promote cooling of the superconducting windings 111. The procedure affords great flexibility to the specific winding, i.e., tape width, wet or dry winding, co-winding of an insulating layer.

FIG. 2 and FIG. 3 depict the overall view of the undulator superconducting windings (or pancake coils) 111 wound according to the new procedure. The magnet core 140 is shown with auxiliary turnaround pins 120. The diameter of these pins 120 is larger than the minimal bend radius of the coated conductor, for example, 0.5". One skilled in the art will appreciate that the bend radius is based on the type of device, typically set by the manufacturer. While a 0.5 inch radius is used in the examples herein, the invention is not limited to such. The turnaround pins 120 are anchored to the magnet core 140 via support fixtures 151, 152, 153 and 154 that are bolted to the front and back faces of the core 140. Bottom support fixtures 144 are also shown in FIG. 2. These bottom support fixtures 144 prevent the motion of the turnaround pins 120 during winding and operation. Furthermore, the bottom support fixtures 144 also provide conduction cooling for the free-standing portion of the superconducting windings 166, which is the section of the pancake coils 111 suspended between a turnaround pin 120 and a corresponding groove 142. The turnaround pins 120 are composed of individual sections 120*a*, 120*b*, 120*c*, 120*d* (in FIG. 2) that screw into each other (see inset of FIG. 2) in such a way that the turnaround pins can be extended as more and more pancake coils 111 are wound. A portion of the tape 160 establishes the transition 165 from one pancake coil 111 to the neighboring pancake coil. The beam pipe 101 is located underneath the core 140.

The entire magnetic structure 100 is designed to operate with conduction cooling. There are cooling passages, including a core coolant passage 170*c* in the center of the core and support coolant passages such as a first support coolant passage 170*a* and a second support coolant passage 170*b* in the center of the turnaround pins for liquid helium enable conduction cooling of the undulator. Typically, these passages 170 work in a gravity-driven thermosiphon loop principle.

A realization of the new winding scheme is shown in FIG. 3. The REBCO coated conductor has been wound continuously in such a way that the electrical current runs in opposite directions from one pancake coil 111 to the next according to FIG. 1 thereby, producing a periodic magnetic field.

Figures 3A, 3B, 3C:
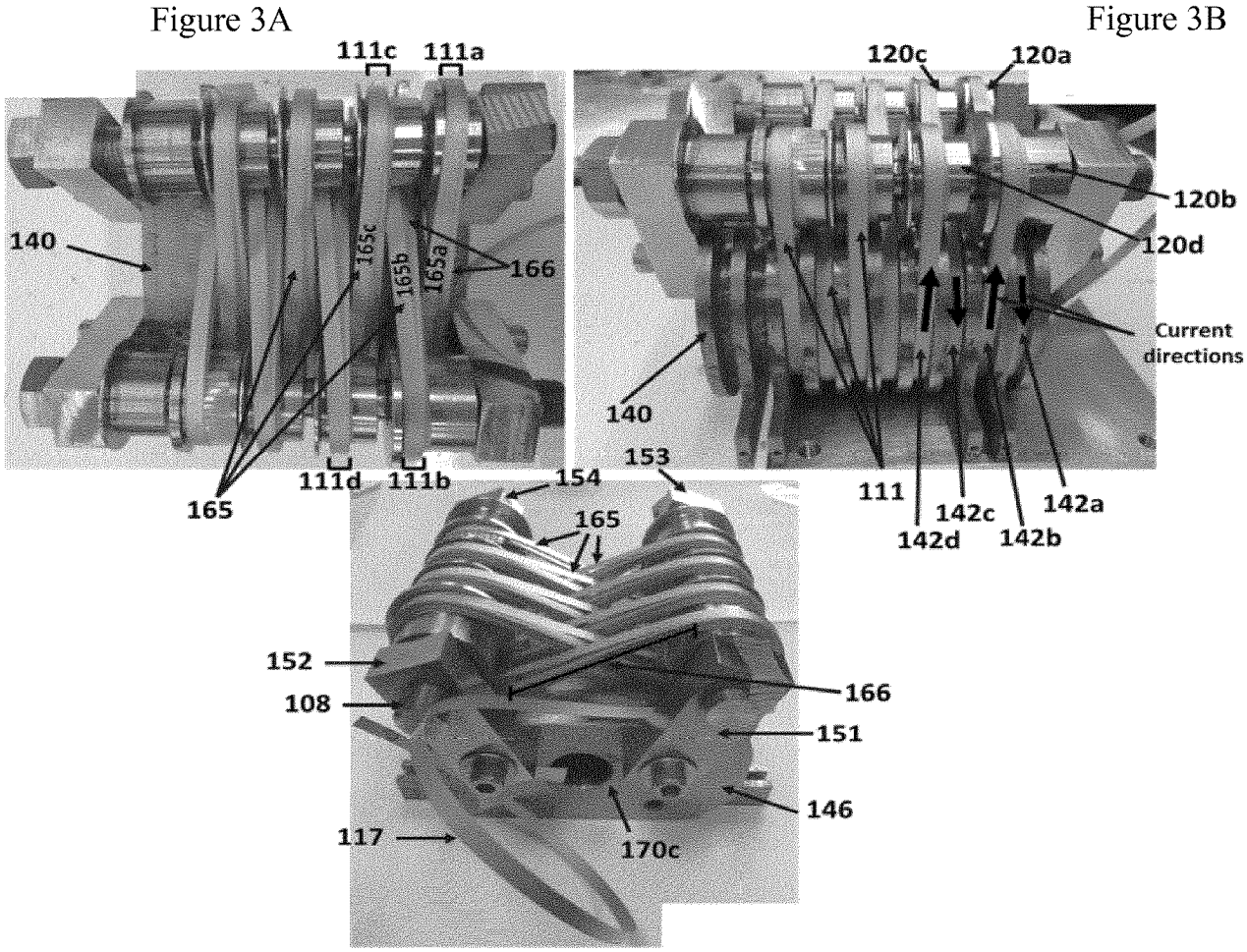
FIG. 3A-C displays photos of REBCO coated conductor wound on a magnet core using the continuous winding scheme described here.

In the embodiment of FIG. 3, the winding of 30 layers of REBCO coated conductor is shown. The number of layers of a winding in one groove 142 is determined from an optimization of getting the highest magnetic field. The embodiment of FIG. 3A-C has four undulator periods. It should be appreciated that any desired number of winding stacks 111 may be formed to provide the desired length of device.

The initial tape portion 117 is used to make a connection to the first external current lead (not shown). A similar tape portion protruding from the other end of the undulator provides a contact to the second external current lead (not shown). The turnaround pins 120 are inserted as the winding process of individual coil pack 111 progresses. The opposing electrical current directions are shown in FIG. 3B.

The winding process starts by threading turnaround pin 120*a* into support fixture 151 using the thread 108 on pin 120*a*. Tape 117, (referred to herein as a tape, but can be a tape, ribbon, or any conducting material in a form factor amenable to winding as described) is wrapped around the first turnaround pin 120*a* from the bottom and laid into the first groove 142*a* as shown in FIG. 3. Enough spare material is left to form the incoming current contact [0024]. Subsequently, tape is wound continuously from a feed spool into groove 142*a* and over pin 120*a* until the desired number turns has been reached. Although a groove is shown and described, it should be appreciated any compatible structure that allows for retention of the winding along a winding path of the core may be used. At this point the first pancake coil 111*a* is completed. In one embodiment, the winding can wrap n times around the core 140, in the groove 142, and the first pin 120 forming a pancake coil 111 that is n layers.

Then, the core is turned such that the feed tape lies flat on the pancake coil section between pin 120*a* and the core, and pin 120*b* is threaded into support fixture 152 with the aid of threads 108 (inset of FIG. 2) in such a way that the tape is located between pin 120*b* and the core. Now the transition 165*a* to the next groove 142*b* is established by sliding the tape slightly along the undulator axis. Now, the winding direction is reversed such that the second turnaround pin 120*b* catches the tape. While continuing to wind and sliding the tape slightly along the undulator axis the tape is fed into the second groove 142*b*. This completes the transition to the second pancake coil, and after the desired number or turns have been completed the process repeats by inserting turnaround pin 120*c*, establishing transition 165*b* and reversing the winding direction again. Any number of pancake coils 111 can be created with this fashion. The length of the turnaround pins has been designed carefully: Pin 120*a* should cover groove 142*a* but not obstruct groove 142*b*. An appropriate length would be $\lambda_u/2$. Pin 120*b* should cover groove 142*b* but not obstruct groove 142*c*, thus a length of $\lambda_u$ would be appropriate. All consecutive sections of pins are inserted by threading them into the existing pieces using the threads shown in the inset of the FIG. 2. In the embodiment illustrated in FIG. 3, the first transition tape portion 165 comprises a single layer or strand of tape. In this scheme, the slanted angle of the transitions 165 arises due to helical winding around the turnaround pins thereby avoiding side-bending of the tape.

In one embodiment, the grooves 142 include slight tapers in the circular sections of the core 140 to further facilitate the transition.

Preferably and advantageously, during this winding procedure the winding tension on the tape is always maintained constant.

This winding scheme can be applied to different configurations of magnetic insertion devices—namely helical and planar undulators, where current flow in different direction is required from one coil to the adjacent one. It can also be applied to different HTS magnet systems such as solenoids made from pancake coils 111 where the current flows in the same direction in each pancake coil. The desired current direction can be obtained by adjusting the tangle by which the tap wraps around the turnaround pins. Adjusting the wrap angle in turnaround pins controls the orientation of the tape. For example, here, the wrapping angle is about ~270 and the current direction is reversed from one winding stacks to another. If the wrapping angle is set ~360, the current direction does not change. The incoming current direction is reversed by 360 degree which makes it same as outgoing direction.

Figure 4:
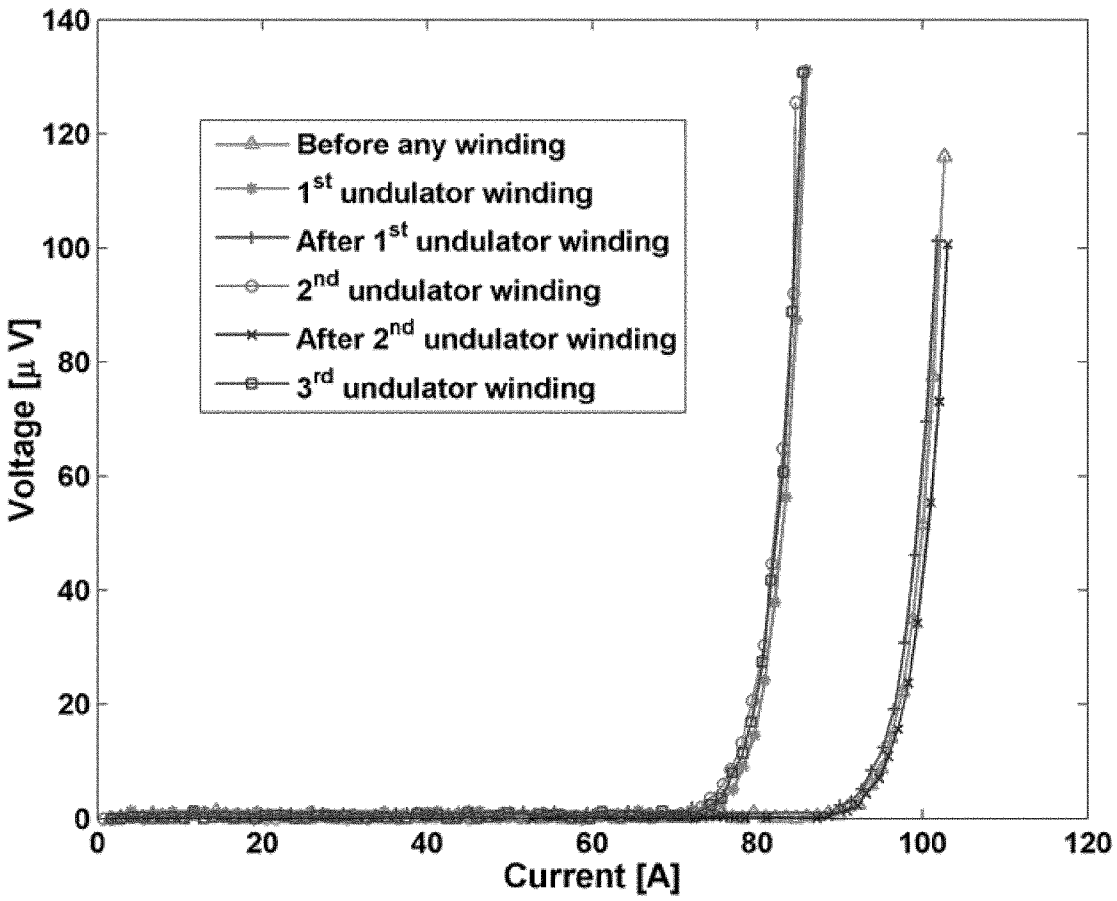
FIG. 4 illustrates current-voltage (I-V) curves of the coil before and after winding demonstrating that there is no degradation in the performance of the REBCO tape due to the winding process of the undulator coil.

FIG. 4 presents the I-V curves of a REBCO tape before and after the winding. The critical current of the tape was measured before winding the coil according to the proposed technique. Then, the undulator coil is wound as shown in FIG. 2 using the same tape. The coil is unwound and the I-V curve is measured in the exact same configuration as before winding. These two I-V curves are compared in this figure showing that the $I_c$ before and after winding is the same. This cycle was repeated several times with the same result demonstrating that this winding scheme does not degrade the REBCO tape.

In one embodiment, the undulator has a period of $\lambda_u$=16 mm, a width of the windings (tape width) of 4 mm and width of the magnetic poles of 4 mm. However, one skilled in the art will appreciate that the described winding scheme can easily be adapted to other dimensions of the undulator. Thus, the dimensions can be changed for the tape or the undulators' structure will utilize the same winding scheme described herein.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An undulator comprising:

a magnetic core having a plurality of parallel grooves at least partially circumferentially about the core;

a plurality of turnaround pins affixed to the core, a first group of more than one turnaround pin of the plurality of turnaround pins positioned along one side of the core and a second group of more than one turnaround pin of the plurality of turnaround pins positioned along the other side of the core, each of the plurality of pins associated with one of the plurality of parallel grooves;

a continuously wound tape, comprised of a conductor or superconductor material, wound about each of the plurality of pins and the associated one of the plurality of parallel grooves, forming a winding stack having a plurality of magnetic coils with alternating polarity;

the continuously wound tape further having a plurality of transition tape portions, each of the plurality of transition tape portions extending from one of the turnaround pins to a succeeding pin, wherein the continuously wound tape is without joints throughout the winding stack.

2. The undulator of claim 1, wherein the continuously wound tape is a high temperature superconductor.

3. The undulator of claim 1, wherein the continuously wound tape is REBCO coated conductor.

4. The undulator of claim 1, wherein each of the plurality of parallel grooves comprise radiused edges.

5. The undulator of claim 1, further comprising a first support structure associated with the first group of the plurality of turnaround pins and a second support structure associated with the second group of the plurality of turnaround pins.

6. The undulator of claim 1, further comprising a plurality of bottom supports, each associated with one of the plurality of parallel grooves.

7. The undulator of claim 1, wherein the undulator is a helical undulator.

8. An undulator comprising:

a magnetic core having a plurality of parallel groves at least partially circumferentially about the core;

a first turnaround pin affixed to the core at adjacent a first side of the core and associated with a first winding path of the core;

a second turnaround pin affixed to the core at adjacent a second side of the core and associated with a second winding path of the core;

a continuously wound tape, comprised of a conductor or superconductor material, wound about each of the first turnaround pin and the first winding path of the core to form a first pancake coil;

a transition portion of the continuously wound tape extending from the first turnaround pin to the second turn around pin without a resistive joint; and the continuously wound tape wound about each of the second turnaround pin and the second winding path of the core to form a second pancake coil; and wherein the first turnaround pin and the second turnaround pin are removably securable to each other.

9. The undulator of claim 8, wherein the continuously wound tape is a high temperature superconductor.

10. The undulator of claim 8, wherein the continuously wound tape is REBCO coated conductor.

11. The undulated of claim 8, wherein each of the first winding path and the second winding path are parallel grooves in the core.

12. The undulator of claim 11, wherein each of the parallel grooves comprise radiused edges.

13. The undulator of claim 8, further comprising a first support structure associated with the first turnaround pin and a second support structure associated with the second turnaround pin.

14. The undulator of claim 8, further comprising a plurality of bottom supports.

15. The undulator of claim 8, wherein the undulator is a helical undulator.

* * * * *